United States Patent [19]

Faulstick et al.

[11] Patent Number: 4,778,056

[45] Date of Patent: Oct. 18, 1988

[54] CONTAINER ADAPTER

[75] Inventors: Luke T. Faulstick, Rochester; Douglas F. Metzger, Hilton, both of N.Y.

[73] Assignee: Eastman Kodak Company, Rochester, N.Y.

[21] Appl. No.: 85,449

[22] Filed: Aug. 14, 1987

[51] Int. Cl.[4] ..... B65D 25/10

[52] U.S. Cl. ..... 206/564; 206/449; 220/410

[58] Field of Search ..... 206/521, 523, 461, 471, 206/557-565, 591-594, 449; 220/410

[56] References Cited

U.S. PATENT DOCUMENTS

| | | | |
|---|---|---|---|
| 3,016,177 | 1/1962 | Chaplin | 229/2.5 R |
| 3,478,867 | 11/1969 | Weiss | 229/2.5 R |
| 3,710,975 | 1/1973 | Jansen | 229/2.5 R |
| 3,726,395 | 4/1973 | Duhy | 229/2.5 R |
| 3,756,383 | 9/1973 | Kryter | 206/387 |
| 3,926,308 | 12/1975 | Sullivan | 206/223 |
| 3,976,193 | 8/1976 | Dogliotti | 229/2.5 R |
| 4,016,972 | 4/1977 | Szamborski | 206/45.34 |
| 4,135,625 | 1/1979 | Merrill | 206/445 |
| 4,361,226 | 11/1982 | Travis | 206/45.31 |
| 4,591,056 | 5/1986 | Groch | 206/564 |
| 4,592,468 | 6/1986 | Wallace | 206/523 |
| 4,718,555 | 1/1988 | Amberg | 229/2.5 R |

FOREIGN PATENT DOCUMENTS

| | | | |
|---|---|---|---|
| 2142472 | 3/1973 | Fed. Rep. of Germany | 206/521 |
| 2328009 | 12/1973 | Fed. Rep. of Germany | 206/564 |
| 2743709 | 3/1978 | Fed. Rep. of Germany | 206/564 |
| 2818538 | 10/1979 | Fed. Rep. of Germany | 220/410 |
| 2547561 | 12/1984 | France | 206/564 |
| 2123786 | 2/1984 | United Kingdom | 206/557 |

*Primary Examiner*—Jimmy G. Foster
*Attorney, Agent, or Firm*—William C. Dixon

[57] ABSTRACT

An article-container adapter is provided to restrain an article from moving inside a container that has sidewalls which define an interior space larger than the article. The adapter has a base, configured to fit snugly inside the container, and a plurality of projections disposed on the base and spaced from each other to receive the article snugly therebetween. The base includes a floor panel having perimetric edge portions engageable with the container sidewalls; and the projections extend upwardly from the floor panel with article-confining surfaces perpendicular thereto. The base may also include outer wall sections extending upwardly from the floor panel perimetric edge portions to engage the container sidewalls; and the projections may then extend inwardly from the outer wall sections to position their article-confining surfaces for engagement by the inserted article. The base may further include a flange extending outwardly from an upper end portion of each outer wall section. Both the base and the projections may be integrally formed as a one-piece plastic insert for packaging various articles in standard-size containers.

2 Claims, 8 Drawing Sheets

CONTAINER ADAPTER

BACKGROUND OF THE INVENTION

1. Field of the Invention

The present invention relates generally to means for preventing an object from moving inside a container larger than the object, and particularly to container adapters that are insertable into an oversize container to protectively restrain objects of various sizes and shapes from moving or rattling therein.

2. Description of the Prior Art

The prior art is replete with cases and containers adapted to carry or display a wide variety of objects. Examples may be found in the following prior-art patents:

- U.S. Pat. No. 3,926,308—Discloses a carrying case that accommodates different-size objects in a nesting arrangement provided by a specially shaped (molded) liner or wall portion at the case bottom.
- U.S. Pat. No. 4,016,972—Discloses a displaying container that accommodates flexible articles of varying lengths in a nesting arrangement provided by specially shaped (molded) base, cover, and intermediate platform portions.
- U.S. Pat. No. 4,135,625—Discloses a container formed from a thin sheet of moldable thermoforming plastic to conformably enclose one or more articles therein and to support the article(s) in a protective outer box during storage, shipping, and handling.
- U.S. Pat. No. 4,361,226—Discloses a displaying container that accommodates a plurality of articles in a nesting arrangement provided by an outer box having top and bottom portions and a specially shaped insert formed (molded) with article-receiving pockets.
- U.S. Pat. No. 4,591,056—Discloses a vacuum-molded compartmentalized receptacle adapted for insertion into a carrying case to hold various sizes and shapes of articles.

While such devices have proven useful for their intended purposes, there has remained a need for article-container adapters that are readily conformable with spatial requirements of articles to be carried in containers having more-than-needed interior space.

SUMMARY OF THE INVENTION

Accordingly, a primary object of the present invention is to meet the foregoing need for such article-container adapters. Another object is to do so in an economical and cost-effective manner. Those and other objects have been achieved by the invention herein claimed.

This invention finds utility in an article-container adapter so constructed as to restrain an article from moving inside a container having sidewalls which define an interior space larger than the article. Such an adapter comprises a base, configured to fit snugly inside the container, and a plurality of projections disposed on the base and spaced from each other so as to receive the article snugly therebetween. The adapter base may include a floor panel having perimetric edge portions engageable with the container sidewalls, and the projections may extend upwardly from the floor panel and include article-confining surfaces substantially perpendicular thereto.

As described and illustrated herein, the base may also include a plurality of outer wall sections extending upwardly from the floor panel perimetric edge portions to engage the sidewalls of the container when placed therein, and the projections may then extend inwardly from such outer wall sections to position their article-confining surfaces for engagemenet by the article when inserted therebetween. The base may further include a flange extending outwardly from an upper end portion of each outer wall section. Preferably, both the base and the projections are integrally formed as one piece.

This invention, and its objects and advantages, will become more apparent in the detailed description of its several embodiments presented hereinbelow.

BRIEF DESCRIPTION OF THE DRAWINGS

In the detailed description of embodiments of this invention presented below, reference is made to the accompanying drawings, wherein like reference numerals denote like elements, and wherein.

DESCRIPTION OF THE ILLUSTRATED EMBODIMENTS

Because certain parts of cases and containers are well known, the following description is directed in particular to those elements forming, cooperating directly with, or relating to, the present invention. Elements not specifically shown or described herein are selectable from those known in the relevant art.

In general, the article-container adapters described below are made from flat sheets of formable plastic. Those sheets are cut from larger flat or roll stock so as to fit, when appropriately formed, into "standard-size" containers, usually boxes. Such boxes are readily available at relatively low cost because of their automated manufacture in large quantities. Each plastic sheet is thermoformed, in a specially prepared adjustable mold (see commonly assigned copending U.S. Patent Application Ser. No. 085,450, MOLD FOR FORMING CONTAINER ADAPTER, filed concurrently herewith and incorporated by reference herein), to provide a one-piece plastic insert configured to fit snugly inside a standard-size box and hold snugly the article to be contained therein.

An insert so configured thus adapts the available space in a standard-size box to the smaller spatial requirements of the article. In so doing, the insert restrains the article from moving or rattling inside the box, and thus protects the article from damage during shipment and handling. When articles of various sizes and shapes are to be contained, use of such inserts with standard-size boxes can substantially reduce the number of more costly special-size boxes that would otherwise be required. Also, since inserts for a variety of articles can be readily molded on site when needed, a significant saving in packaging and delivery time can be realized.

The several illustrated embodiments of this invention will now be described with reference to their respective drawing figures.

FIRST EMBODIMENT

Figure 1:
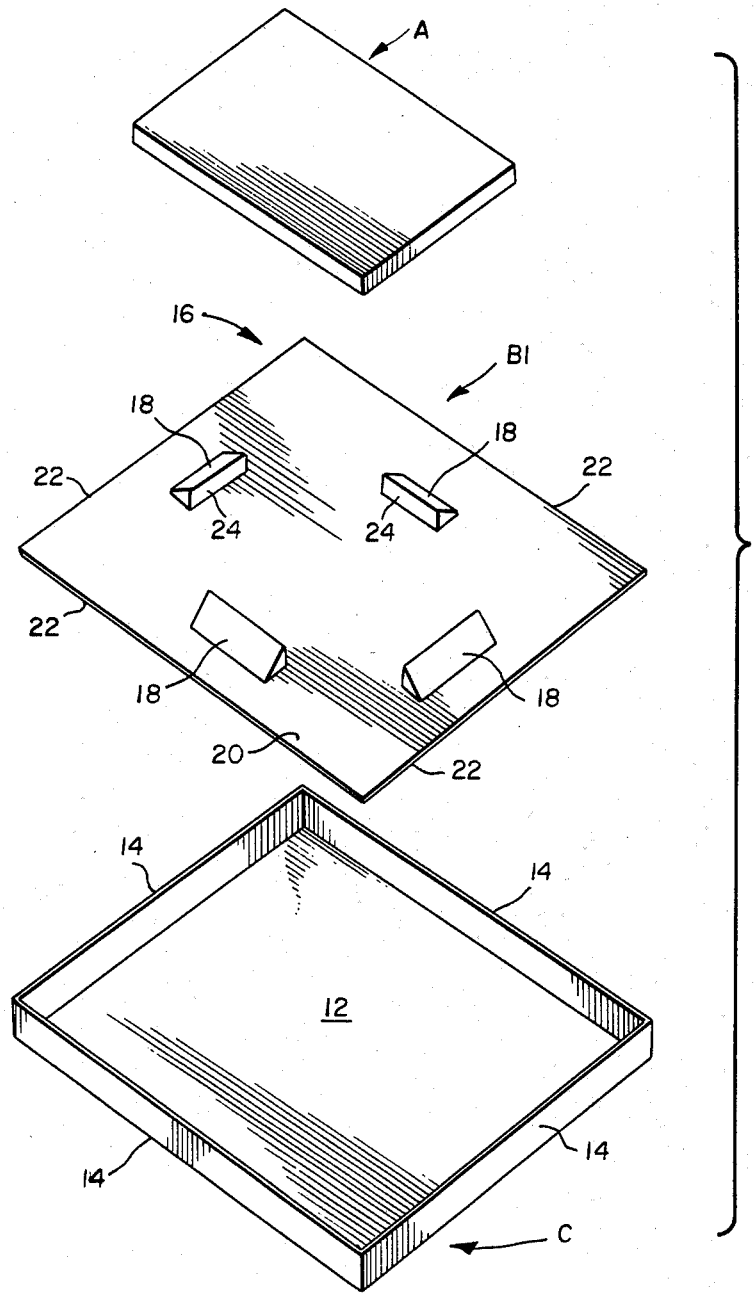
FIG. 1 is a schematic perspective view illustrating an article-container adapter configured in accordance with a first embodiment of the invention.

FIG. 1 illustrates, in perspective, an article A to be contained within a standard-size container C by means of an article-container adapter B1. Container C includes a bottom wall 12 and four upstanding sidewalls 14 which define an interior space larger than the article. Adapter B1 includes a base 16, configured to fit snugly inside the container, and a plurality of projections 18 (four shown) that are disposed on the base and are spaced from each other so as to receive the article snugly therebetween. Base 16 includes a floor panel 20 having perimetric edge portions 22 that are engageable with the container sidewalls 14. Projections 18 extend upwardly from floor panel 20 and include article-confining surfaces 24 substantially perpendicular thereto. In use, adapter B1 is inserted into container C so that floor panel 20 rests on bottom wall 12 and edge portions 22 abut the inside surfaces of sidewalls 14, thereby ensuring a snug fit between the mated adapter and container. Article A is then inserted into the space between projections 18, so that the article rests on top of panel 20 with its sides respectively disposed adjacent to, and facing, the article-confining surfaces 24, thereby ensuring a snug fit between the mated article and adapter. In forming this adapter, the spacing between its opposing surfaces 24 is selected to provide the degree of snugness needed to prevent lateral movement or rattling of the inserted article. With the article thus protectively held in place, the open top of container C may then be closed by a suitable cover or lid (not shown).

SECOND EMBODIMENT

Figure 5:
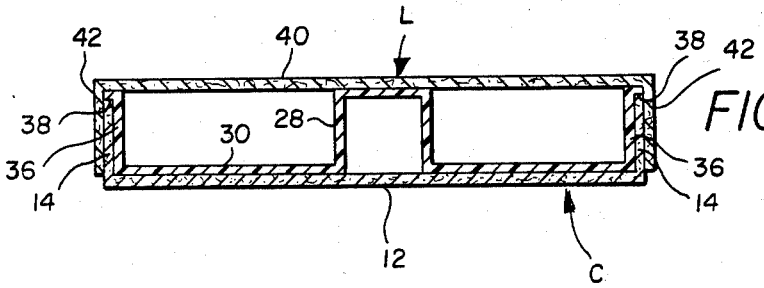

FIGS. 2–5 illustrate an adapter B2 which is easier to manufacture than that in FIG. 1. Adapter B2 includes a base 26, configured to fit snugly inside container C, and a plurality of projections 28 thereon (four shown) that are spaced from each other so as to receive article A snugly therebetween. Base 26 includes a floor panel 30 having perimetric edge portions 32 engageable with container sidewalls 14. Projections 28 extend upwardly from floor panel 30 and include article-confining surfaces 34 substantially perpendicular thereto. Base 26 also includes a plurality of outer wall sections 36 extending upwardly from the floor panel perimetric edge portions 32 to engage container sidewalls 14. It will be seen that projections 28 extend, not only upwardly from floor panel 30, but also inwardly from outer wall sections 36 so as to position their article-confining surfaces 34 appropriately for engagement by the inserted article. Extending outwardly from an upper end portion of each outer wall section 36 is a flange 38 (FIG. 3) which overlaps an upper edge portion of the respectively engaged sidewall 14 (FIG. 5). As illustrated, projections 28 take the form of rectangular blocks whose article-confining surfaces 34 are rectangular. Alternatively, the projections could assume some other polygonal configuration, with their article-confining surfaces having a correspondingly different shape, e.g., trapezoidal. In manufacturing adapter B2, its base 26 and projections 28 may be integrally formed as a one-piece molded plastic part. With added strength and rigidity achieved by the combination of projections 28, outer wall sections 36, and flanges 38, the projections may be shortened so as to place their article-confining surfaces relatively close to their corresponding outer wall sections, and thereby permit receipt of larger articles within a given-size container. Also as a result of such added strength and rigidity, wall thicknesses may be reduced and a corresponding reduction in material cost realized. Once the adapter and article ae snugly received inside the container, a suitable cover or lid L may be placed thereover as shown in FIG. 5. Lid L includes a top wall 40, which rests on the top surfaces of projections 28 and flanges 38, and four depending sidewalls 42 (two shown) which closely surround the four container sidewalls 14.

THIRD EMBODIMENT

Figure 2:
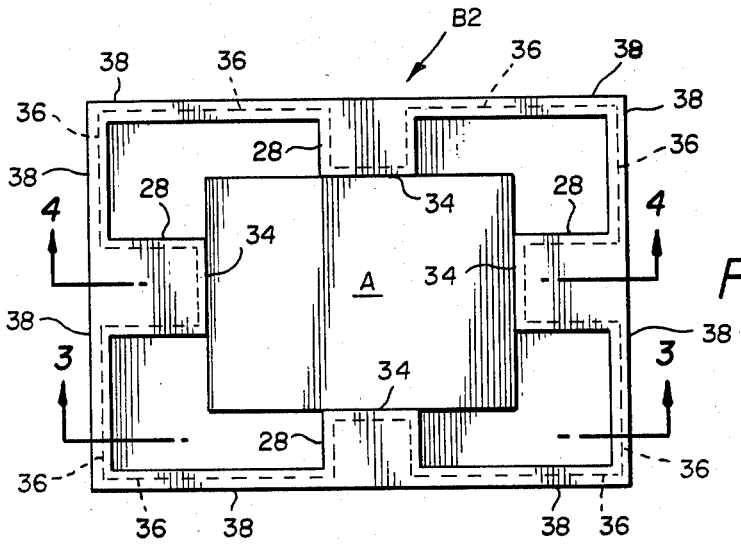
FIG. 2 and FIGS. 3–5 are top-plan and cross-sectional views, respectively, illustrating an article-container adapted configured according to a second embodiment of this invention, FIGS. 3 and 5 being taken along line 3—3 in FIG. 2, and FIG. 4 along line 4—4.
Figure 3:
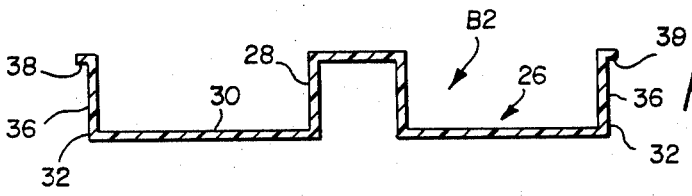
Figure 4:
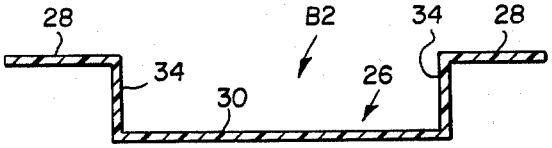
Figure 6:
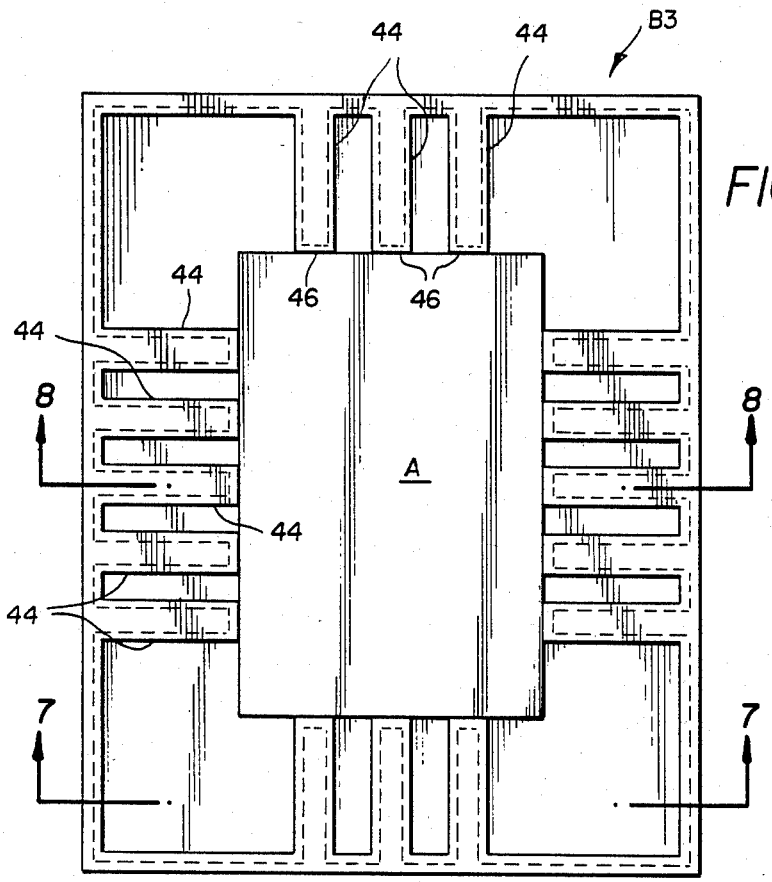
FIG. 6 and FIGS. 7–8 are top-plan and cross-sectional views, respectively, depicting an article-container adapter according to a third embodiment of the invention, FIGS. 7 and 8 being taken respectively along lines 7—7 and 8—8 in FIG. 6.
Figure 7:
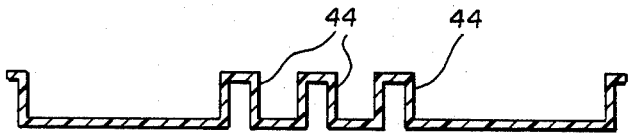
Figure 8:
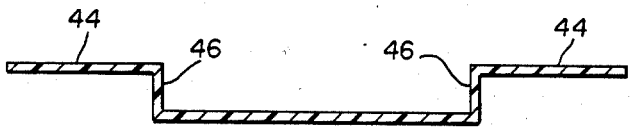

FIGS. 6–8 illustrate an adapter B3 which is similar to adapter B2 but differs therefrom in one significant respect. As shown in FIG. 2, adapter B2 has a single rectangular-block-shaped projection 28 extending inwardly from each side thereof. As shown in FIG. 6, adapter B3 has a plurality of distinct, relatively narrow, rectangular-block-shaped projections 44 extending inwardly from each side, each such projection presenting its own article-confining surface 46 for engagement by a corresponding area of an inserted article. This increase in the number of projections provides even greater strength and rigidity than can be achieved in adapter B2, such that wall thicknesses, material cost, molding cycle time, and corresponding labor cost may all be reduced.

FOURTH EMBODIMENT

Figure 9:
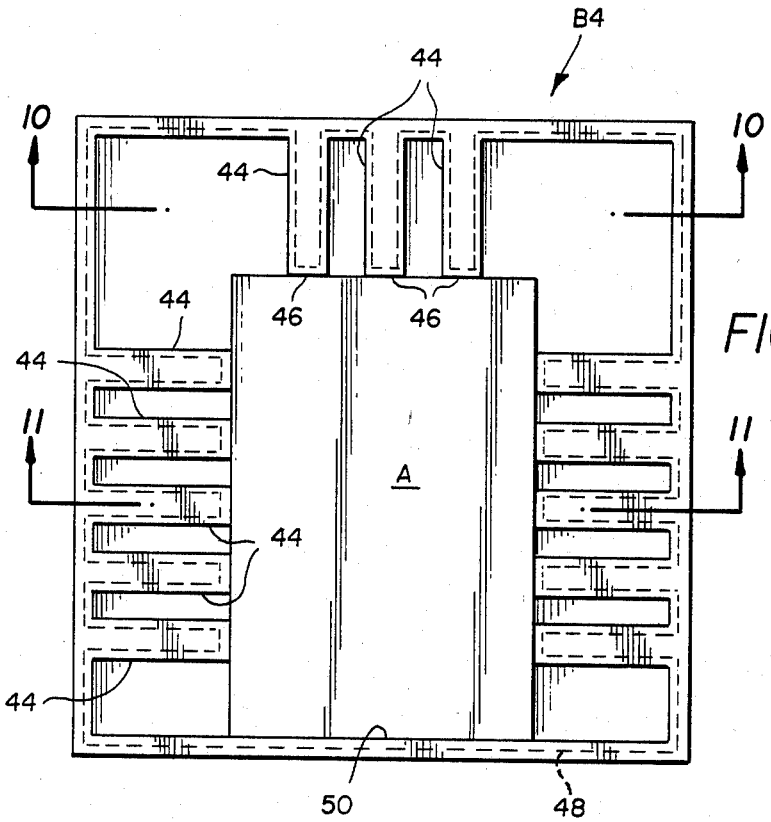
FIG. 9 and FIGS. 10–11 are top-plan and cross-sectional views, respectively, depicting an article-container adapter according to a fourth embodiment of the invention, FIGS. 10 and 11 being taken respectively along lines 10—10 and 11—11 in FIG. 9.
Figure 10:
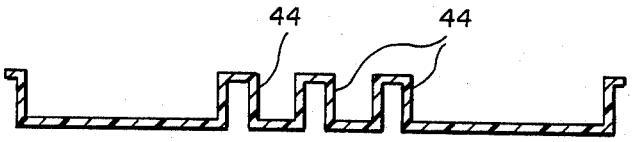
Figure 11:
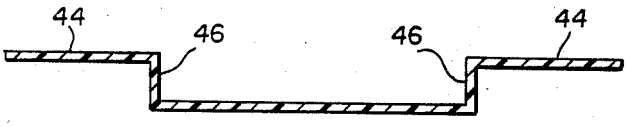

FIGS. 9–11 illustrate an adapter B4 which is identical to adapter B3 except that the projections 44 in adapter B4 project inwardly from only three of its four sides. As shown in FIG. 9, there are no projections extending from outer wall section 48. Instead, inward-facing surface 50 of wall section 48 itself provides the article-confining surface needed at the fourth side. This arrangement allows a further reduction in material and molding costs.

FIFTH (THE PREFERRED) EMBODIMENT

Figure 12:
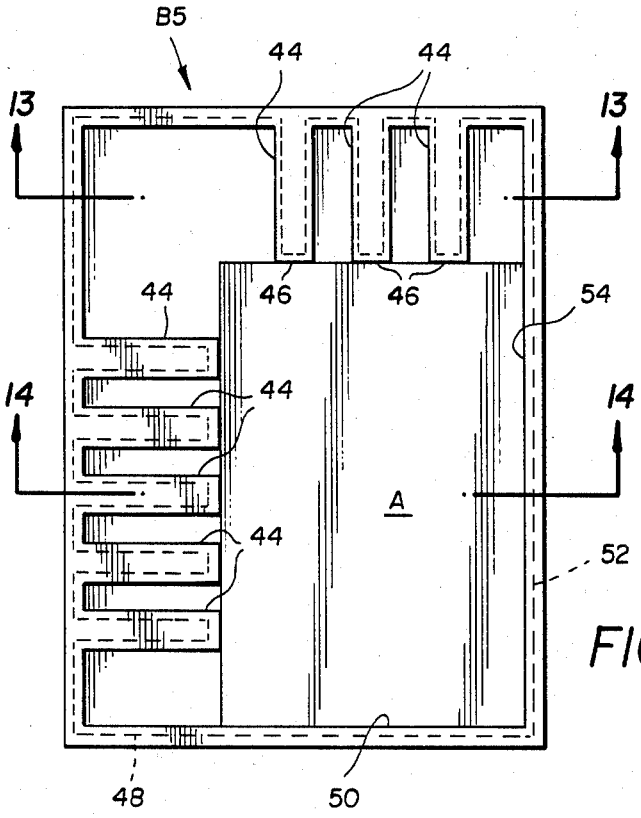
FIG. 12 and FIGS. 13–14 are top-plan and cross-sectional views, respectively, showing an article-container adapter according to a fifth (the preferred) embodiment, FIGS. 13 and 14 being taken respectively along lines 13—13 and 14—14 in FIG. 12.
Figure 13:
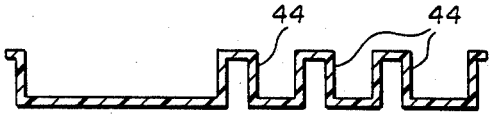
Figure 14:
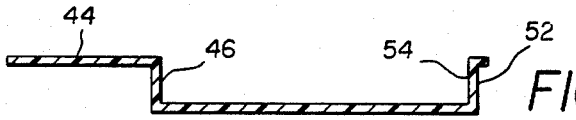
Figure 15:
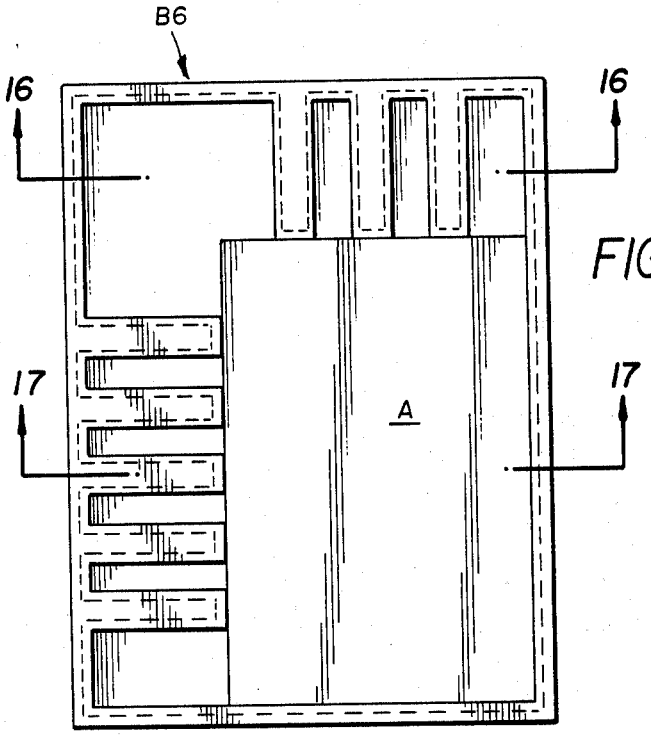
FIG. 15 and FIGS. 16–18 are top-plan and cross-sectional views, respectively, showing an article-container adapter according to a sixth embodiment, FIGS. 16 and 18 being taken along line 16—16 in FIG. 15, and FIG. 17 along line 17—17.
Figure 16:
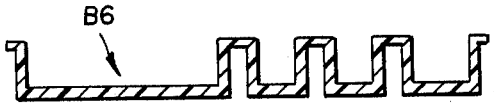
Figure 17:
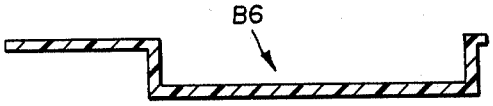

FIGS. 12–14 illustrate an adapter B5 identical to adapter B4 except that this adapter has projections 44 extending inwardly from only two sides thereof. As shown in FIG. 12, there are no projections extending from either of outer wall sections 48 and 52. Instead, inward-facing surfaces 50 and 54 of wall sections 48 and 52 respectively provide the article-confining surfaces needed at those sides. This arrangement offers an added degree of flexibility, in that it simplifies molding of a smaller adapter to mate with a smaller-size container, in order to accommodate a given size of article with less wasted air space inside the adapter. As a result, still further reductions in adapter material and molding costs, and a lower container cost, can be realized.

SIXTH EMBODIMENT

Figure 18:
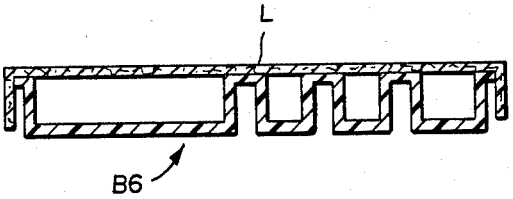
Figure 19:
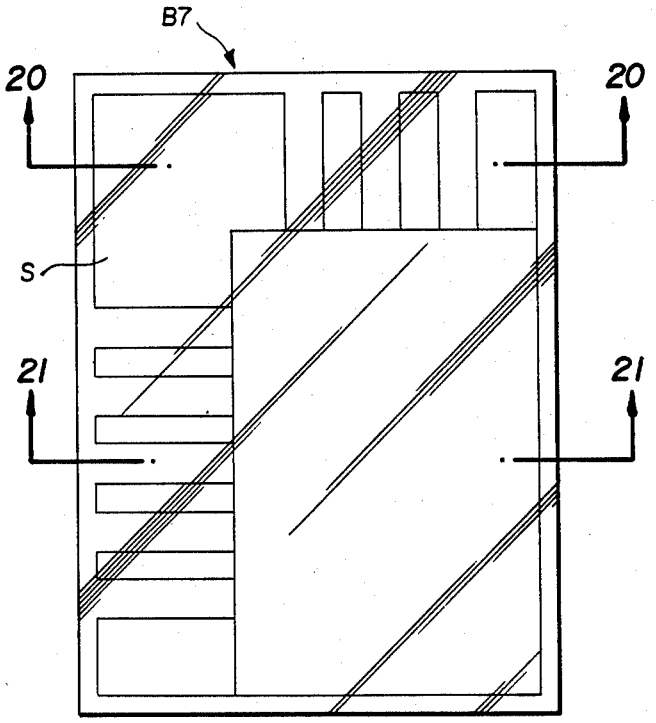
FIG. 19 and FIGS. 20–22 are top-plan and cross-sectional views, respectively, of an article-container adapter according to a seventh embodiment, FIG. 20 and FIGS. 21–22 being taken respectively along line 20—20 and line 21—21 in FIG. 19.
Figure 20:
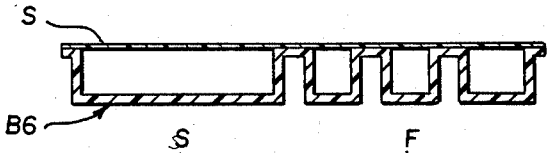
Figure 21:
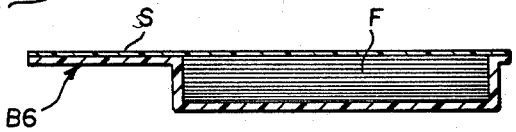

FIGS. 15–18 illustrate an adapter B6 identical to adapter B5 except that this adapter is molded with sufficient wall thickness and opacity to obviate a container bottom (such as that shown as container C in FIG. 5). As depicted in FIG. 18, container C is absent but cover or lid L (as shown in FIG. 5) is placed on the top surfaces of this adapter with its depending sidewalls closely surrounding the adapter flanges. This arrangement thus eliminates the entire cost of the container bottom.

SEVENTH EMBODIMENT

Figure 22:
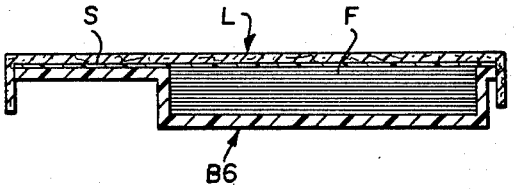

FIGS. 19–22 illustrate an adapter B7 which combines adapter B6 with a plastic or metal-foil sealing layer S sealed across the open top thereof. This embodiment is especially useful in applications requiring protection of the article from moisture, light, and/or environmental contaminants. For example, a pack of photographic film sheets F can be adequately protected by this arrangement without having to seal the pack separately inside its own foil bag, as is customary. In use with film pack F, after the pack is snugly seated inside the adapter, sealing layer S is placed on top of the adapter and sealed to its flanges. Lid L may then be placed over the sealing layer, with its depending sidewalls surrounding the flanges as shown in FIG. 22. This arrangement thus not only eliminates all costs associated with a separately sealed bag; it also provides a measure of protection against, or at least a ready means for discovering, any attempted product tampering.

EIGHTH EMBODIMENT

Figure 23:
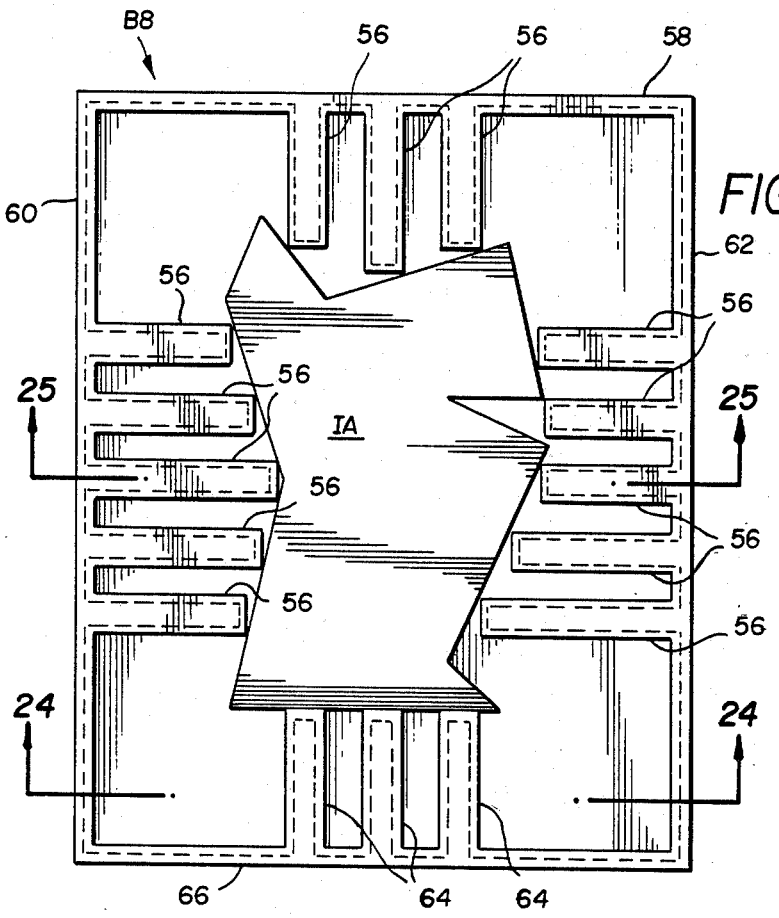
FIG. 23 and FIGS. 24–25 are top-plan and cross-sectional views, respectively, of an article-container adapter according to an eighth embodiment, FIGS. 24 and 25 being taken respectively along lines 24—24 and 25—25 in FIG. 23.
Figure 24:
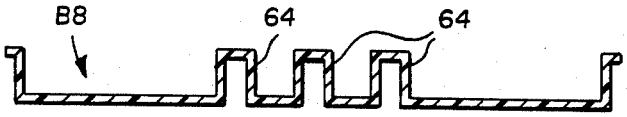
Figure 25:
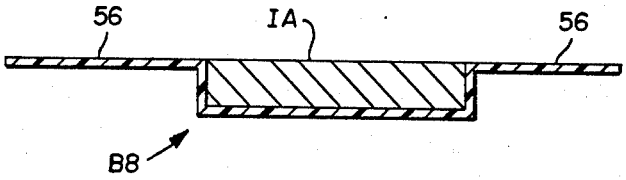

FIGS. 23–25 illustrate an adapter B8 which is similar to adapter B3 (third embodiment) but differs therefrom in that its projections on at least one side extend inwardly therefrom by differing amounts, in order to accommodate an inserted article having an outward-facing surface which is not parallel with that adapter side. This arrangment is useful where the article is not rectangular. For example, a circular article such as a roll of film can be snugly received by this adapter. FIG. 23 shows another example wherein adapter B8 has projections 56 extending inwardly by differing amounts from each of sides 58, 60, and 62, and projections 64 extending equidistantly from side 66, to accommodate irregular-shaped article IA.

The present invention has now been described in detail with particular reference to its illustrated embodiments. It will be understood, however, that further variations and modifications can be effected within the spirit and scope of this invention.

What is claimed is:

1. A container adapter, provided to restrain an article from moving inside a container that includes upstanding sidewalls having upward-facing edge portions and defining an interior space larger than the article, said adapter comprising:

a base configured to fit snugly inside the container, said base including a floor panel having perimetric edge portions with outer wall sections projecting upwardly therefrom to engage the sidewalls of the container when placed therein, said outer wall sections each having an upper end portion with a flange projecting outwardly from it to overlie one of the sidewall upward-facing edge portions; and a plurality of projections disposed on said base and spaced from each other so as to receive the article snugly between them, said projections extending upwardly from said floor panel and including article-confining surfaces substantially perpendicular thereto, said projections also extending inwardly from said outer wall sections to position said article-confining surfaces for engagement by the article when inserted therebetween, said article-confining surfaces including a plurality of polygonal surface areas engageable by the inserted article, at least some of said plurality of polygonal surface areas being spaced inwardly from one of said outer wall sections by differing amounts, to engage a portion of the inserted article when that portion and said one of said outer wall sections are nonparallel; whereby, when said adapter is snugly disposed in the container and the article is so disposed in said adapter, the article is restrained from moving inside the container.

2. A container adapter, provided to restrain an article from moving inside a container that includes upstanding sidewalls having upward-facing edge portions and defining an interior space larger than the article, said adapter comprising:

a base configured to fit snugly inside the container, said base including a floor panel having perimetric edge portions with outer wall sections projecting upwardly therefrom to engage the sidewalls of the container when placed therein, said outer wall sections each having an upper end portion with a flange projecting outwardly from it to overlie one of the sidewall upward-facing edge portions; and a plurality of projections disposed on said base and spaced from each other so as to receive the article snugly between them, said projections extending upwardly from said floor panel and including article-confining surfaces substantially perpendicular thereto, said projections also extending inwardly from said outer wall sections to position said article-confining surfaces for engagement by the article when inserted therebetween, said article-confining surfaces including a plurality of polygonal surface areas engageable by the inserted article;

whereby, when said adapter is snugly disposed in the container and the article is so disposed in said adapter, the article is restrained from moving inside the container;

in combination with said container and a complemental lid therefor, said lid including a top wall portion coextensive with said container and side wall portions that depend from said top wall portion to closely surround said container sidewalls, wherein:

said adapter is snugly disposed inside said container, with said outer wall sections thereof engaging said container sidewalls and with the flanges on said outer wall sections overlying the upward-facing edge portions of said sidewalls; and said lid is snugly disposed on said container, with said top wall portion thereof engaging said flanges and with said side wall portions thereof closely surrounding said sidewalls;

whereby said adapter is snugly enclosed by said container and said lid.

* * * * *